US006370849B1

(12) United States Patent
Merker et al.

(10) Patent No.: US 6,370,849 B1
(45) Date of Patent: Apr. 16, 2002

(54) SYNTHETIC SADDLE TREE FOR RIDING SADDLES

(75) Inventors: Curt Merker, Munich; Hjalmar Konzet, Inzell, both of (DE)

(73) Assignee: Georg Kieffer Sattlerwarenfabrik GmbH, Munich (DE)

( * ) Notice: Subject to any disclaimer, the term of this patent is extended or adjusted under 35 U.S.C. 154(b) by 0 days.

(21) Appl. No.: 09/505,918

(22) Filed: Feb. 17, 2000

(30) Foreign Application Priority Data

Sep. 6, 1999 (DE) ..... 299 15 679 U

(51) Int. Cl.[7] ..... B68C 1/02; B68C 1/08; B68C 1/10

(52) U.S. Cl. ..... 54/44.1; 54/44.5; 54/44.7

(58) Field of Search ..... 54/44.1, 44.5, 54/44.7

(56) References Cited

U.S. PATENT DOCUMENTS 57,214 A * 8/1866 Stockton et al.
286,674 A * 10/1883 Bassler
307,615 A * 11/1884 Adams et al.
3,286,440 A * 11/1966 Walker et al.
3,712,024 A * 1/1973 Nankivell ..... 54/44.7
3,835,621 A * 9/1974 Gorenschek ..... 54/44.7
3,888,070 A * 6/1975 White et al. ..... 54/44.7
4,004,402 A * 1/1977 Bischeltsrieder ..... 54/44.7
4,130,979 A * 12/1978 Bischeltsrieder ..... 54/44.3
5,048,272 A * 9/1991 Saare ..... 54/44.1
5,191,752 A * 3/1993 Murphy ..... 54/44.5
5,517,808 A * 5/1996 Schleese ..... 54/44.6

* cited by examiner

*Primary Examiner*—Charles T. Jordan
*Assistant Examiner*—Yvonne R. Abbott
(74) *Attorney, Agent, or Firm*—Milde, Hoffberg & Macklin, LLP

(57) ABSTRACT

A synthetic saddle tree for riding saddles having a shell-shaped seat region (4) and an upwards raised pommel section (6) attaching thereto at the front and running towards the withers of the horse is characterised in that in the seat region a window (14) covered by a pad (16) is left open. Thus, a saddle having a softer seat region can be manufactured in this way than saddles using conventional synthetic saddle trees.

28 Claims, 1 Drawing Sheet

SYNTHETIC SADDLE TREE FOR RIDING SADDLES

BACKGROUND OF THE INVENTION

The present invention relates to a synthetic saddle tree for riding saddles having a shell-shaped seat region and a raised pommel section attached thereto at the front and running towards the withers of the horse.

Such synthetic saddle trees are common nowadays in series production of riding saddles. They offer the advantage of economical manufacture and low weight. Even though they carry a layer of padding lying underneath the top leather, normally in the form of a foam section manufactured to shape, there is from time to time the need to design the saddle softer in the seat region.

SUMMARY OF THE INVENTION

The principal object of the invention is to design a synthetic saddle tree in accordance with the preamble, such that it satisfies the need for softer padding in the seat region.

This object as well as other objects which will become apparent from the discussion that follows, are achieved according to the present invention , by providing a window in the seat region which expose pad arranged in this region.

Since the pad in question on the saddle tree does not encounter a hard layer, the saddle padding in the seat region can be designed softer in the relevant manner. Although a window occurred naturally in saddle trees manufactured traditionally by hand from wooden sections and leather strips, which were essentially frame-shaped. These, however, were tedious to manufacture manually, relatively high and above all heavy. For the saddle trees mentioned at the outset, which are shell-shaped in the seat region, such a window represents a novelty.

For a full understanding of the present invention, reference should now be made to the following detailed description of the preferred embodiments of the invention as illustrated in the accompanying drawing.

DESCRIPTION OF THE PREFERRED EMBODIMENT

Figure 1:
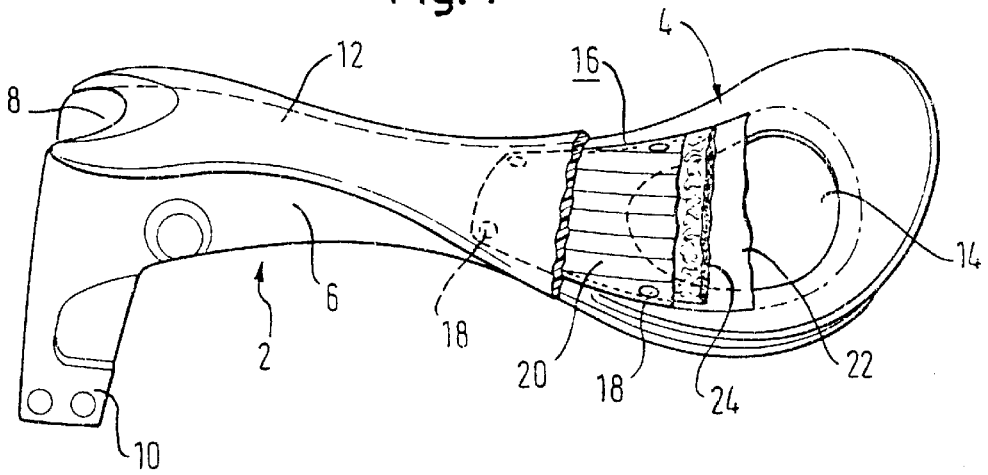
FIG. 1 is a partly exploded perspective view of the synthetic saddle tree in question complete with a pad and layer of padding.

The preferred embodiments of the present invention will now be described with reference to FIGS. 1–3 of the drawing. Identical elements in the various figures are designated with the same reference numerals.

The illustrated synthetic saddle tree presents a one-piece body 2, which is generally injection-moulded from polypropylene, nylon or polyurethane, having a shell-shaped seat region 4 and an upwards raised pommel section 6 attaching thereto at the front and running towards the withers of the horse, on the front end of which flaps 10 adjoin, under a recess 8 for the withers of the horse.

In a by and large normal manner body 2 bears a suitably shaped layer of padding in the form of foam section 12 manufactured to shape. However, an approximately circular window 14 is left open in the seat region 4 and is covered by a pad 16. More precisely, pad 16, which just overlaps pommel 6, lies with its upper edge on the edge of window 14, where it is fastened with rivets 18. It consists of two stitched together leather or imitation leather flaps 20 and 22, between which is inserted a conventional padding material 24, such as foam, wool, felt or even a gel, for example.

Instead of this, pad 16 can be designed from straps, rubber strips, a rubber web or a rubber plate. In a simplified design pad 16 can also be designed from foam layer 12 which in this case exhibits on its underside a flat extension 26 reaching into window 14, as illustrated in FIG. 3.

In the case of a separately designed pad 16, foam layer 12, as compared to the type of foam layer utilised in conventional synthetic saddle trees, will correspondingly be recessed to accommodate the edges of pad 16, in particular.

Figure 2:
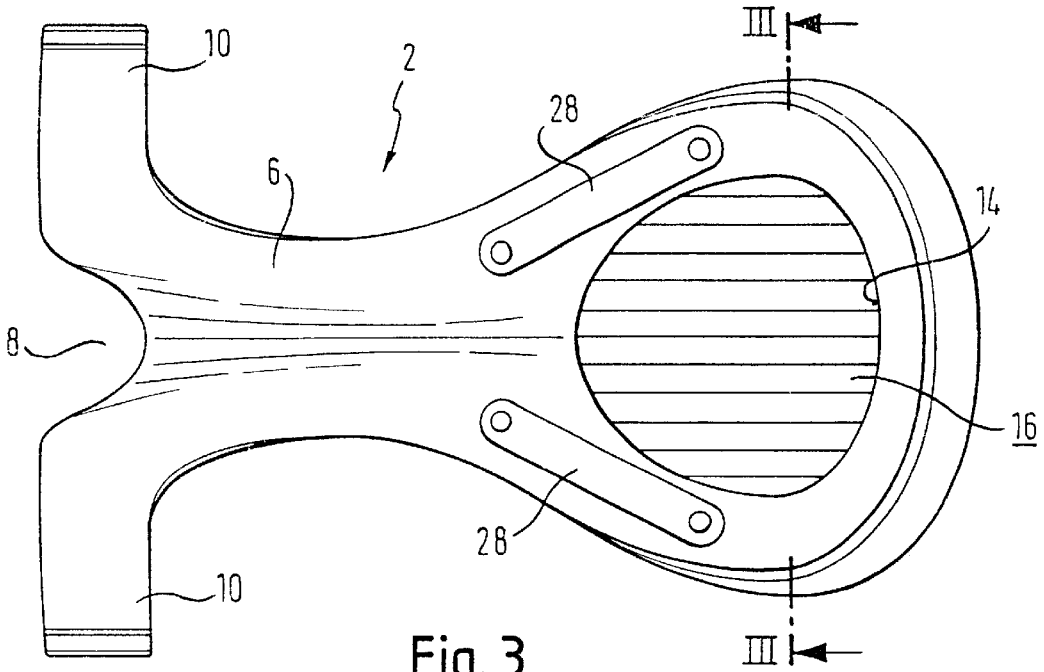
FIG. 2 is a view from below the saddle tree in question.
Figure 3:
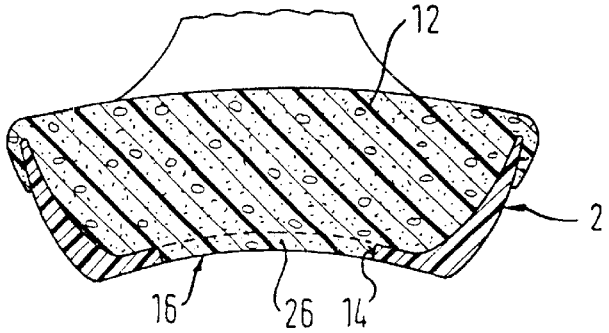
FIG. 3 shows a section approximately along line III—III in FIG. 2, though of a somewhat simplified embodiment.

Since body 2 is naturally weakened because of window 14 it can be reinforced on its underside, at least on both sides of window 14 and in the direction of pommel 6, by metallic inserts or supports such as metal strips 28 illustrated in FIG. 2. In the illustrated example metal strips 28 are riveted at their ends to body 2. They can, however, also be screwed, glued or formed in.

There has thus been shown and described a novel synthetic saddle tree for riding saddles which fulfills all the objects and advantages sought therefor. Many changes, modifications, variations and other uses and applications of the subject invention will, however, become apparent to those skilled in the art after considering this specification and the accompanying drawing which discloses the preferred embodiment thereof. All such changes, modifications, variations and other uses and applications which do not depart from the spirit and scope of the invention are deemed to be covered by the invention, which is to be limited only by the claims which follow.

What is claimed is:

1. In a synthetic saddle tree for riding saddles having a shell-shaped seat region and an upwards raised pommel section joined thereto at the front and extending towards the withers of the horse, the improvement wherein the seat region of the saddle tree includes a substantially circular, central window which is covered by a pad, and wherein the pad comprises two stitched together leather or imitation leather flaps, between which is inserted padding material.

2. A synthetic saddle tree as claimed in claim 1, wherein the pad comprises members selected from the group consisting of straps, rubber strips, a rubber web and a rubber plate.

3. A synthetic saddle tree as claimed in claim 1, wherein the pad extends over an edge of the window on the upper side.

4. A synthetic saddle tree as claimed in claim 3, wherein an edge of the pad is riveted on to the edge of the window.

5. A synthetic saddle tree as claimed in claim 1, wherein the saddle tree as a whole includes a foam layer.

6. A synthetic saddle tree as claim in claim 5, wherein the pad is comprised at least substantially of the foam layer.

7. A synthetic saddle tree as claimed in claim 6, wherein the foam layer exhibits a flat extension reaching into the window.

8. A synthetic saddle tree as claimed in claim 1, wherein the saddle tree is reinforced by metallic inserts or supports.

9. A synthetic saddle tree as claimed in claim 8, wherein the metallic inserts or supports are attached flat and at both ends.

10. A synthetic saddle tree as claimed in claim 9, wherein the metallic inserts or supports are attached by a device selected from the group consisting of rivets, screws and glue.

11. A synthetic saddle tree as claimed in claim 8, wherein the inserts are formed into the body of the saddle tree.

12. A synthetic saddle tree as claimed in claim 8, wherein the saddle tree is reinforced on its underside.

13. A synthetic saddle tree as claimed in claim 8, wherein the saddle tree is reinforced on both sides of the window and in the direction of the pommel.

14. A synthetic saddle tree as claimed in claim 1, wherein the padding material is selected from the group consisting of foam, wool, felt and gel.

15. In a synthetic saddle tree for riding saddles having a shell-shaped seat region and an upwards raised pommel section joined thereto at the front and extending towards the withers of the horse, the improvement wherein the seat region of the saddle tree includes a substantially circular, central window which is covered by a pad, and wherein the saddle tree as a whole includes a foam layer.

16. A synthetic saddle tree as claimed in claim 15, wherein the pad comprises two stitched together leather or imitation leather flaps, between which is inserted padding material.

17. A synthetic saddle tree as claimed in claim 16, wherein the padding material is selected from the group consisting of foam, wool, felt and gel.

18. A synthetic saddle tree as claimed in claim 15, wherein the pad comprises members selected from the group consisting of straps, rubber strips, a rubber web and a rubber plate.

19. A synthetic saddle tree as claimed in claim 15, wherein the pad extends over an edge of the window on the upper side.

20. A synthetic saddle tree as claimed in claim 19, wherein an edge of the pad is riveted on to the edge of the window.

21. A synthetic saddle tree as claim in claim 20, wherein the pad is comprised at least substantially of the foam layer.

22. A synthetic saddle tree as claimed in claim 21, wherein the foam layer exhibits a flat extension reaching into the window.

23. A synthetic saddle tree as claimed in claim 15, wherein the saddle tree is reinforced by metallic inserts or supports.

24. A synthetic saddle tree as claimed in claim 23, wherein the metallic inserts or supports are attached flat and at both ends.

25. A synthetic saddle tree as claimed in claim 24, wherein the metallic inserts or supports are attached by a device selected from the group consisting of rivets, screws and glue.

26. A synthetic saddle tree as claimed in claim 23, wherein the inserts are formed into the body of the saddle tree.

27. A synthetic saddle tree as claimed in claim 23, wherein the saddle tree is reinforced on its underside.

28. A synthetic saddle tree as claimed in claim 23, wherein the saddle tree is reinforced on both sides of the window and in the direction of the pommel.

* * * * *